United States Patent [19]

Buchwald et al.

[11] Patent Number: 4,492,641

[45] Date of Patent: Jan. 8, 1985

[54] PROCESS FOR THE CHIP FORMING, CUTTING OR ABRASIVE WORKING OF METALS

[75] Inventors: Hans Buchwald, Hanover; Boleslaus Raschkowski, Wiedensahl, both of Fed. Rep. of Germany

[73] Assignee: Kali-Chemie AG, Hanover, Fed. Rep. of Germany

[21] Appl. No.: 556,393

[22] Filed: Nov. 30, 1983

[30] Foreign Application Priority Data

Dec. 2, 1982 [DE] Fed. Rep. of Germany ..... 3244543

[51] Int. Cl.[3] ..... C10M 1/30

[52] U.S. Cl. ..... 252/48.4; 252/48.8; 252/54.6; 252/58

[58] Field of Search ..... 252/48.4, 48.8, 58, 252/54.6

[56] References Cited

U.S. PATENT DOCUMENTS

| | | | |
|---|---|---|---|
| 3,129,182 | 4/1964 | McLean | 252/58 |
| 3,909,431 | 9/1975 | Figiel | 252/58 |
| 4,084,737 | 4/1978 | Gorman et al. | 252/58 |
| 4,428,851 | 1/1984 | Hesamoto et al. | 252/58 |

*Primary Examiner*—Jacqueline V. Howard

*Attorney, Agent, or Firm*—Schwartz, Jeffery, Schwaab, Mack, Blumenthal & Koch

[57] ABSTRACT

A process for chip forming, cutting or abrasive treatment of metals using a fluorochlorohydrocarbon containing cooling lubricant is described. The lubricant contains esters of long chain carboxylic acids and monoalcohols having a total of 34 to 50 carbon atoms or derivatives of said esters. Also disclosed is a cooling lubricant to be used in the process and a process for the preparation of such a cooling lubricant.

21 Claims, No Drawings

PROCESS FOR THE CHIP FORMING, CUTTING OR ABRASIVE WORKING OF METALS

BACKGROUND OF THE INVENTION

The present invention relates to a process for chip forming, cutting or abrasive working of metals with the use of a cooling lubricant containing a fluorochlorohydrocarbon, to a cooling lubricant suitable for the process and also to a process for the preparation of such a cooling lubricant.

Chip forming, cutting or abrasive working of metals, in other words, metal working processes such as, for example, drilling, cutting, stamping, milling, turning, grinding, are carried out in the presence of cooling lubricants. According to one process disclosed in German Auslegeschrift No. 21 00 757, a cooling lubricant consisting of or containing trichloromonofluoromethane is used. In a variant of the process, this cooling lubricant may contain further compounds, but no such compounds are listed individually or as classes of chemical substances. It is therefore left to the knowledge of a person of ordinary skill in the art to make a selection from known additives. Thus, from U.S. Pat. No. 3,129,182 a cooling lubricant based on 1,1,2-trichloro-1,2,2-trifluoroethane is known, which contains as an additive ethyleneglycol monobutylether. German Offenlegunsschrift No. 21 00 735 and British Pat. No. 1,272,548 disclose nitroalkanes with 1 to 2 carbon atoms as aditives for 1,1,2-trichloro-1,2,2-trifluoroethane. Further, from U.S. Pat. No. 3,909,431 a cooling lubricant is known based on fluorochlorohydrocarbon (hereafter FCH) which contains cyclohexanone as an additive.

According to the state of the art, either pure FCH is employed as the cooling lubricant, which however, by itself often does not yield satisfactory results, or FCH is used with additives, which may be objectionable in view of their toxicity. Thus, for example, the maximum concentration value for the workplace (MWC value) for ethyleneglycol monobutylether and cyclohexanone is set at 50 ppm, and when using these additives, the permissible MWC values are easily exceeded. Furthermore, the skin- and mucosa-irritating effects and the liver- and kidney-damaging effects of cyclohexanone are known, and health-related objections exist for ethyleneglycol monobutylether, particularly in view of its ready absorption through the skin.

SUMMARY OF THE INVENTION

It is therefore an object of the present invention to provide an improved cooling lubricant composition.

It is also an object of the invention to eliminate the disadvantages of the state of the art and, in particular, to provide a new, toxicologically unobjectionable cooling lubricant.

A further object of the invention resides in providing a process for chip forming, cutting or abrasive working of metals with the use of the improved cooling lubricant.

It is a further object of the invention to provide a process particularly adapted to the preparation of the improved cooling lubricant.

In accomplishing the foregoing objects, there has been provided according to one aspect of the present invention a process for working of metals using a cooling lubricant containing a fluorochlorohydrocarbon, wherein the cooling lubricant comprises from about 0.5 to 25% and preferably 0.5 to 5% by weight of an ester of a long chain carboxylic acid and a monoalcohol having a total of 34 to 50 carbon atoms, and/or a sulfochlorinated or sulfided derivative of said ester. Preferably, the cooling lubricant comprises from about 99.5 to 75% and in particular 99.5 to 95% by weight of a fluorochlorohydrocarbon having 1 or 2 carbon atoms and a boiling point greater than about 20° C.

In accordance with another aspect of the present invention, there has been provided a cooling lubricant for use in a process of the type defined above, comprising a fluorochlorohydrocarbon and from about 0.5 to 25% by weight of an ester of a long chain carboxylic acid and a monoalcohol having a total of 34 to 50 carbon atoms, and/or a sulfochlorinated or sulfided derivative of said ester.

In accordance with still another aspect of the invention, there has been provided a process for the preparation of a cooling lubricant as defined above, comprising the steps of extracting a vegetable material containing the esters with a fluorochlorohydrocarbon having 1 or 2 carbon atoms and a boiling point of more than about 20° C., and adjusting the extract containing the esters to an ester content of from about 0.5 to 25% by weight. Preferably, the extraction is carried out as a counterflow extraction and the process further comprises the step of continuously adjusting the ester content by measuring at least one property of the extractant which is indicative of ester content.

Further objects, features and advantages of the present invention will become apparent from the detailed derscription of preferred embodiments which follows.

DETAILED DESCRIPTION OF PREFERRED EMBODIMENTS

The new process for the chip forming, cutting or abrasive working of metals using a cooling lubricant containing a FCH is characterized in that esters of long chain carboxylic acids and monoalcohols with a total of from about 34 to 50 carbon atoms and/or their sulfochlorinated or sulfided derivatives are added to the cooling lubricant in quantities of from about 0.5 to 25% by weight, preferably 0.5 to 5% by weight.

The esters of long chain carboxylic acids and monoalcohols (i.e., alcohols with one OH group) which are added to the FCH-containing cooling lubricants may be employed as such or as sulfochlorinated or sulfided derivatives. Preferred are esters with iodine values of less than about 95. One variant includes esters with iodine values of less than approximately 20, which hereafter are designated saturated esters. A further variant comprises esters with iodine values within a range of approximately 80 to 90; these are designated unsaturated esters. In another variant, esters with iodine values between approximately 20 and approximately 40, partially saturated esters, are used. Both the saturated, partially saturated and unsaturated esters as well as the sulfochlorinated and sulfided esters are available as commercial products.

In a particular variant the cooling lubricant containing FCH comprises from about 99.5 to 75% by weight, preferably from about 99.5 to 95% by weight, of a fluorochlorohydrocarbon having 1 to 2 carbon atoms and a boiling point in excess of about 20° C. In particular, trichloromonofluoromethane, 1,1,2-trichloro-1,2,2-trifluoroethane, 1,1,2,2-tetrachlorodifluoroethane, tetrachloromonofluoroethane and/or trichlorodifluoroethane may be used.

A further variant provides that, in cases wherein the cooling lubricant evaporates too rapidly by itself, up to about 35% by weight, preferably up to about 15% by weight, of the FCH may be replaced by a toxicologically unobjectionable solvent which controls evaporation. For example, lower aliphatic ketones with 3 to 4 carbon atoms are suitable. The solvent which controls evaporation normally has a higher boiling point than the FCH used. Ethanol, n- and/or i-propanol are especially preferred.

A further variant provides for the addition of solubilizers for the esters. This is especially desirable when saturated partially saturated and/or sulfochlorinated or sulfided esters are used. As ester solubilizers, known, toxicologically unobjectionable solvents with solubilizing properties may be employed; they may replace up to about 10% by weight of the FCH.

A preferred embodiment provides for the use as ester solubilizers of aliphatic hydrocarbons which are also used as evaporation controllers, in a concentration of up to about 15% by weight of the FCH. For example, corresponding aliphatic hydrocarbons or gasoline fractions, e.g., gasoline fractions with a boiling range of from bout 40°-80° C. may be used. Preferred are such hydrocarbons capable of forming an azeotrope with the FCH. Optimally, a concentration corresponding to the azeotropic composition is used. The addition of n-heptane has been found to be especially useful.

A further preferred embodiment consists of selecting the ester solubilizer from the group of long chain aliphatic alcohols, which contain from about 16 to 24 carbon atoms and preferably one or more carbon-carbon double bonds.

A further embodiment of the invention consists of the addition to the cooling lubricant of up to about 1% by weight based on the FCH, of conventional corrosion inhibitors. Corrosion inhibitors of this type for metals such as, for example, magnesium, aluminum, titanium, brass, bronze, and steel, are commercially available. They are based mostly on compositions containing organic compounds with hetero atoms such as sulfur or particularly nitrogen. Especially suitable are, for example, individual compounds or mixtures of the class of benzothiazols, for example, mercaptobenzothiazol, benzimidazols, e.g., 2-phenylbenzimidazol, triazols, e.g., benzotriazols, tolyltriazols, oxazolines, e.g., oxazolines substituted by alkyl and/or hydroxyalkyl, amides, amines, e.g., tertiary amines.

When corrosion inhibitors are used, one embodiment of the invention provides for the replacement of up to 10% by weight of the FCH by solubilizers for the inhibitors. The selection of inhibitor solubilizers is governed by the same general guidelines as the choice of ester solubilizers. Preferred solubilizers both for the inhibitor and the esters are lower aliphatic alcohols with 1 to 5 carbon atoms. Of these ethanol, n- and/or i-propanol are particularly preferred; advantageously they may be employed simultaneously as evaporation controllers, as mentioned hereinabove.

In addition to the processes for working metals, the invention comprises also the cooling lubricant used in said process, with the composition of said lubricant satisfying the foregoing definition. If an additive belongs to several classes of additives, its maximum concentration should be calculated not additively, but rather it is governed by the highest individual concentration.

The cooling lubricant described in the foregoing may be applied for the working of metals by all known methods of application. It may be applied, for example, as a liquid or as an aerosol. It can also be applied externally, i.e., introduced to the tool from the outside, or internally, i.e. by means of suitable conduits provided in the tool itself. The internal application will be employed, for example, in the drilling of deep bores or in internal grinding. The cooling lubricant according to the invention can also be used generally for the abrasive treatment of hard surfaces.

Good results are obtained with the process of the invention for chip forming, cutting or abrasive working of metals. Thus, compared with the use of trichloromonofluoromethane alone, an appreciably reduced consumption of energy is observed in the chip forming, cutting or abrasive treatment of metals such as magnesium, aluminum, titanium, brass, bronze, and steel. This observation is especially apparent when compact pieces of metal are to be drilled, milled or cut, for example.

Surprisingly, the improvement is particularly apparent when the cooling lubricant contains a corrosion inhibitor, preferably based on oxazoline.

The process according to the invention furthermore assures a satisfactory removal of chips, and cutting buildups are prevented. Cooling and lubricating properties are very good.

Furthermore, it has been surprisingly found that practically no greasing of the metal surface takes place, which would not be expected in view of the wax- or oil-like nature of the esters added.

As the result of the toxicological safety of the cooling lubricant, there is moreover no danger of exceeding the maximum workplace limits (MWC values) set by regulations.

The invention furthermore pertains to a specially adapted process for the preparation of the cooling lubricant according to the invention. The process provides for the direct extraction of the vegetable material containing the said esters, or extraction of their alcoholic extract with a FCH, in particular, a FCH with 1 or 2 carbon atoms and a boiling point in excess of 20° C. The process furthermore provides for the adjustment of the extract, possibly with the addition of the said additives, to an ester content of from about 0.5 to 25% by weight, preferably from about 0.5 to 5% by weight. An alcoholic extract is defined, in particular, as an extract obtained with ethanol, n- and/or i-propanol.

In a particularly preferred variant, the extraction is carried out as a continuous counter flow extraction, and the continuous adjustment of the ester content is controlled by measuring the index of refraction or the density.

In the examples given hereinbelow, the composition is given of cooling lubricants according to the invention which have been found to be particularly effective in the working of metals.

All percentages are by weight. Furthermore, IN = iodine number, SC = sulfochlorinated, i.e., a product obtained by the addition of sulfur and chlorine to the double bond of the unsaturated ester. R 11 = trichloromonofluoromethane, R 112 = 1,1,2,2-tetrachlorodifluoroethane, R 113 = 1,1,2-trichloro-1,2,2-trifluoroethane, R 121 = tetrachloromonofluoroethane, R 122 = trichlorodifluoroethane.

The esters and corrosion inhibitors used are commercial products. The agent based on triazol is on the basis of a benzotriazol, and the oxazoline agent is based on an oxazoline substituted by an alkyl and a hydroxyalkyl.

refraction at 20° C. = 1.464) are obtained (corresponding to a yield of approximately 46%).

| | EXAMPLES 1-12 | | | | | | | | | | | |
|---|---|---|---|---|---|---|---|---|---|---|---|---|
| EXAMPLE | 1 | 2 | 3 | 4 | 5 | 6 | 7 | 8 | 9 | 10 | 11 | 12 |
| R 11 | 98.5 | 49.0 | | | | | | | | | | |
| R 112 | | | 49.0 | 70.9 | | | | | | | | |
| R 113 | | 49.0 | 49.0 | | 98.5 | 95.9 | 64.0 | 85.5 | 98.3 | 97.0 | 94.8 | |
| R 121 | | | | | | | | | | | | 98.5 |
| Ester, IN = 90-80 | 1.5 | 2.0 | 2.0 | 1.5 | 1.5 | 1.5 | 1.5 | 1.5 | 1.5 | 3.0 | 5.0 | 1.5 |
| i-Propanol | | | | 27.6 | | | 34.5 | | | | | |
| n-Propanol | | | | | | 2.6 | | | | | | |
| Acetone | | | | | | | | 13.0 | | | | |
| Corr.-Inhibitor Based on tert. Amine | | | | | | | | | 0.2 | | | |
| Corr.-Inhibitor Based on Oxazoline | | | | | | | | | | | 0.2 | |

| | EXAMPLES 13-24 | | | | | | | | | | | |
|---|---|---|---|---|---|---|---|---|---|---|---|---|
| EXAMPLE | 13 | 14 | 15 | 16 | 17 | 18 | 19 | 20 | 21 | 22 | 23 | 24 |
| R 11 | 98.5 | 98.3 | | | | | | 98.5 | | | | |
| R 112 | | | 93.6 | 93.4 | 93.4 | | | | 93.6 | 93.4 | | |
| R 113 | | | | | | | | | | | | |
| R 121 | | | | | | 98.5 | | | | | | |
| R 122 | | | | | | | 98.3 | | | | 98.5 | 98.3 |
| Ester IN = 90-80 | | | | | | | | | | | 1.5 | |
| Ester IN = 40-20 | 1.5 | 1.5 | 1.5 | 1.5 | 1.5 | 1.5 | 1.5 | | | | | |
| Ester IN = 20-0 | | | | | | | | 1.5 | 1.5 | 1.5 | | 1.5 |
| n-Heptane | | | 4.9 | 4.9 | 4.9 | | | | 4.9 | 4.9 | | |
| Corr-Inhibitor Based on tert. Amine | | | | 0.2 | | | | | | 0.2 | | |
| Corr. Inhibitor Based on Oxazoline | | 0.2 | | | 0.2 | | 0.2 | | | | | 0.2 |

| | EXAMPLES 25-35 | | | | | | | | | | |
|---|---|---|---|---|---|---|---|---|---|---|---|
| EXAMPLE | 25 | 26 | 27 | 28 | 29 | 30 | 31 | 32 | 33 | 34 | 35 |
| R 11 | 98.5 | 49.0 | | | | | | | | | |
| R 112 | | | 49.0 | 93.6 | | | | | | | |
| R 113 | | 49.0 | 49.0 | | 98.5 | 94.6 | 96.8 | 91.2 | 98.0 | | |
| R 121 | | | | | | | | | | 98.5 | |
| R 122 | | | | | | | | | | | 98.3 |
| Ester IN = 90-80 | | | | | | | | | 1.0 | | |
| Ester, SC | 1.5 | 2.0 | 2.0 | 1.5 | 1.5 | 1.5 | 3.0 | 5.0 | 1.0 | 1.5 | 1.5 |
| Ethanol | | | | | | 3.7 | | 3.6 | | | |
| i-Propanol | | | | 4.9 | | | | | | | |
| Corr.-Inhibitor Based on Triazole | | | | | | 0.2 | | 0.2 | | | |
| Corrs.-Inhibitor Based on Oxazoline | | | | | | | 0.2 | | | | 0.2 |

EXAMPLE 36

To prepare a cooling lubricant according to the invention, seed grains containing unsaturated esters (IN = 80-90) (25 g) are ground to a fineness of 2 mm and extracted in a Soxhlet extraction apparatus with 250 g R 113. After 20 strokes a clear yellow extract with the following properties is obtained:

density (20° C.): 1.506 g/ml ester content: 6%

The extract may be employed directly as such or diluted with R 113 to 1.5% by weight (density 1.560).

To determine the yield, the extract is condensed, and 11.4 g ester (density at 20° C. = 0.863 g/ml, index of Gas chromatographic analysis showed that more than ¾ of the mixture consisted of unsaturated esters having 40 and 42 carbon atoms. The rest was distributed over shorter or longer chain esters within a range of 36 to 44 C atoms.

What is claimed is:

1. In a process for working of metals using a cooling lubricant containing a fluorochlorohydrocarbon, the improvement comprising said cooling lubricant comprising from about 0.5 to 25% by weight of an ester of a long chain carboxylic acid and a monoalcohol having a total of 34 to 50 carbon atoms, and/or a sulfochlorinated or sulfided derivative of said ester.

2. A process according to claim 1, wherein said fluorochlorohydrocarbon-containing cooling lubricant comprises from about 0.5 to 5% by weight of said ester and/or derivative.

3. A process according to claim 1, wherein the cooling lubricant comprises from about 99.5 to 75% by weight of a fluorochlorohydrocarbon having 1 or 2 carbon atoms and a boiling point greater than about 20° C.

4. A process according to claim 3, wherein the cooling lubricant comprises from about 99.5 to 95% by weight of a fluorochlorohydrocarbon having 1 or 2 carbon atoms and a boiling point greater than about 20° C.

5. A process according to claim 1, wherein the cooling lubricant comprises up to about 35% by weight of said fluorochlorohydrocarbon, of a toxicologically acceptable solvent which is capable of controlling evaporation of the cooling lubricant.

6. A process according to claim 5, wherein said solvent is present in an amount up to about 15% by weight based upon said fluorochlorohydrocarbon.

7. A process according to claim 5, wherein said solvent comprises ethanol, n-propanol, i-propanol or a mixture thereof.

8. A process according to claim 1, wherein said ester has an iodine number of less than about 95.

9. A process according to claim 1, wherein said cooling lubricant comprises up to about 10% by weight of the fluorochlorohydrocarbon of an agent suitable for controlling the solubility of said ester.

10. A process according to claim 9, wherein said solubility controlling agent comprises an aliphatic hydrocarbon or a higher aliphatic alcohol.

11. A process according to claim 10, wherein said aliphatic hydrocarbon forms an azeotrope with the fluorochlorohydrocarbon.

12. A process according to claim 11, wherein said aliphatic hydrocarbon comprises n-heptane.

13. A process according to claim 10, wherein said higher aliphatic alcohol has from about 16 to 24 carbon atoms.

14. A process according to claim 1, wherein said cooling lubricant further comprises up to about 1% by weight of said fluorochlorohydrocarbon of a corrosion inhibitor.

15. A process according to claim 14, wherein said cooling lubricant comprises up to about 10% of said fluorochlorohydrocarbon of an agent for controlling the solubility of said corrosion inhibitor.

16. A process according to claim 15, wherein said solubility controlling agent for said corrosion inhibitor comprises a lower aliphatic alcohol having 1 to 5 carbon atoms which forms an azeotrope with said fluorochlorohydrocarbon.

17. A process according to claim 16, wherein said solubility controlling agent for said corrosion inhibitor comprises ethanol, n-propanol, i-propanol or a mixture thereof.

18. A cooling lubricant for use in a process according to claim 1, comprising a fluorochlorohydrocarbon and from about 0.5 to 25% by weight of an ester of a long chain carboxylic acid and a monoalcohol having a total of 34 to 50 carbon atoms, and/or a sulfochlorinated or sulfided derivative of said ester.

19. Process for the preparation of a cooling lubricant according to claim 18, comprising the steps of extracting a vegetable material containing said esters with a fluorochlorohydrocarbon having 1 or 2 carbon atoms and a boiling point of more than about 20° C., and adjusting the extract containing the esters to an ester content of from about 0.5 to 25% by weight.

20. A process according to claim 19, wherein said extraction is carried out as a counter-flow extraction and further comprising the step of continuously adjusting the ester content by measuring at least one property of the extractant which is indicative of ester content.

21. A process according to claim 9, wherein said solubility controlling agent comprises a lower aliphatic alcohol having 1 to 5 carbon atoms.

* * * * *